US009199698B2

(12) United States Patent
Urciuoli

(10) Patent No.: US 9,199,698 B2
(45) Date of Patent: Dec. 1, 2015

(54) MARINE CRAFT ENGAGEMENT

(75) Inventor: Joseph Charles Urciuoli, North Easton, MA (US)

(73) Assignee: Mactaggart, Scott (Holdings) Limited, Loanhead (GB)

( * ) Notice: Subject to any disclaimer, the term of this patent is extended or adjusted under 35 U.S.C. 154(b) by 0 days.

(21) Appl. No.: 13/413,298

(22) Filed: Mar. 6, 2012

(65) Prior Publication Data

US 2012/0227655 A1 Sep. 13, 2012

Related U.S. Application Data

(63) Continuation-in-part of application No. 13/042,118, filed on Mar. 7, 2011.

(51) Int. Cl.

| | |
|---|---|
| ***B63B 23/00*** | (2006.01) |
| ***B63B 21/56*** | (2006.01) |
| *B63C 3/02* | (2006.01) |
| *B63B 35/40* | (2006.01) |

(52) U.S. Cl.

CPC ..... *B63B 23/00* (2013.01); *B63B 21/56* (2013.01); *B63B 35/40* (2013.01); *B63C 3/02* (2013.01)

(58) Field of Classification Search

CPC ..... B63B 21/58; B63B 21/56; B63B 23/00; B63B 35/40

USPC ..... 114/254, 258, 259, 248, 249, 250; 405/205, 206

See application file for complete search history.

(56) References Cited

U.S. PATENT DOCUMENTS

| | | | | |
|---|---|---|---|---|
| 3,430,305 | A | 3/1969 | Geffner | |
| 3,807,335 | A | 4/1974 | Talkington | |
| 3,830,186 | A * | 8/1974 | Janssen et al. | 114/249 |
| 3,937,163 | A | 2/1976 | Rosenberg | |
| 3,943,875 | A | 3/1976 | Sanders | |
| 3,955,522 | A | 5/1976 | Gaudiano | |
| 5,253,605 | A | 10/1993 | Collins | |
| 6,676,334 | B2 | 1/2004 | Horton, III | |
| 7,156,036 | B2 | 1/2007 | Seiple | |
| 7,699,015 | B1 | 4/2010 | Said | |
| 8,225,735 | B1 * | 7/2012 | Galway | 114/242 |
| 2006/0254491 | A1 | 11/2006 | Seiple | |

FOREIGN PATENT DOCUMENTS

| | | |
|---|---|---|
| WO | 0121476 | 3/2001 |

OTHER PUBLICATIONS

European Search Report received in corresponding EP Application No. EP12158411, dated Nov. 30, 2012.

(Continued)

*Primary Examiner* — Lars A Olson

(74) *Attorney, Agent, or Firm* — Blank Rome, LLP

(57) ABSTRACT

An engagement apparatus for use in the deployment and recovery of a marine craft from a mother ship comprises a receptacle provided on one of the marine craft and the mother ship and an engagement probe provided on the other of the marine craft and the mother ship. The receptacle has a number of spaced channels which receive the engagement probe, engagement between the probe and the channels facilitating alignment between the marine craft and the mother ship. A locking device is also provided to secure the probe to the receptacle to secure the marine craft to the mother ship for recovery. The locking device may be activated by full engagement between the probe and the receptacle.

14 Claims, 8 Drawing Sheets

(56) References Cited

OTHER PUBLICATIONS

European Search Report received in corresponding EP Application No. EP12158413, date Jun. 19, 2012.
Office Action issued on U.S. Appl. No. 13/041,938 dated Jun. 11, 2012.
Final Office Action issued on U.S. Appl. No. 13/041,938 dated Jan. 15, 2013.
Office Action issued on U.S. Appl. No. 13/042,118 dated Jun. 13, 2012.
Office Action issued on U.S. Appl. No. 13/042,118 dated Jan. 22, 2013.

* cited by examiner

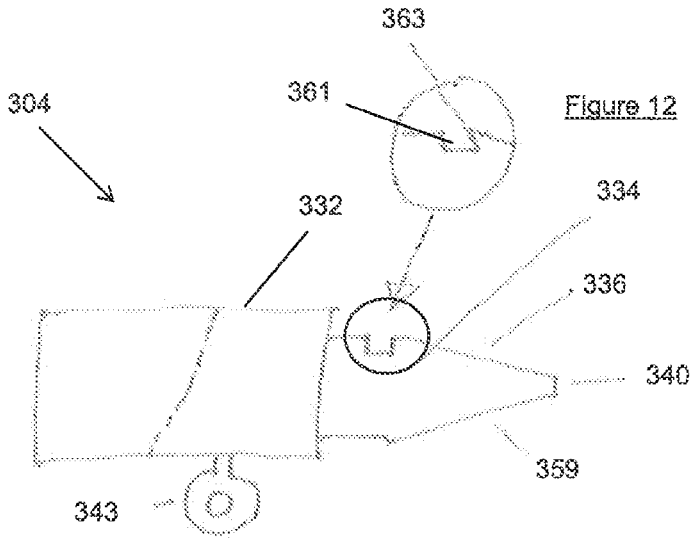
Figure 12
Figure 11
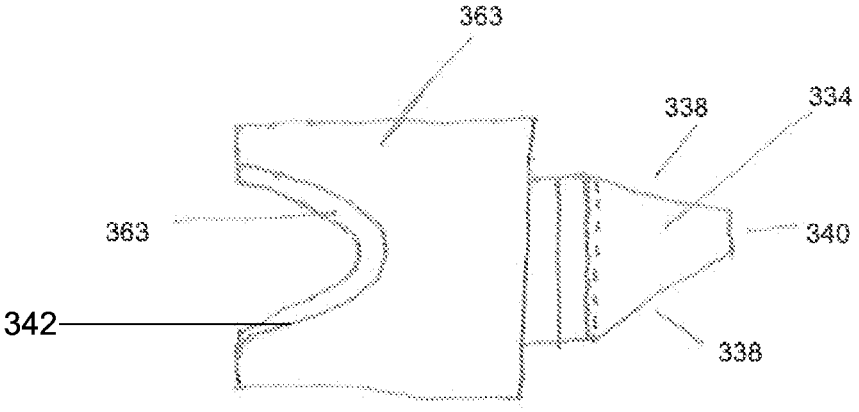
Figure 13

MARINE CRAFT ENGAGEMENT

CROSS REFERENCE TO RELATED APPLICATIONS

This present application is a continuation-in-part of pending U.S. patent application Ser. No. 13/042,118 filed on Mar. 7, 2011, the contents of which are incorporated herein by reference.

FIELD OF THE INVENTION

This invention relates to an engagement apparatus and associated method for use in a marine craft recovery system. In particular, but not exclusively, embodiments of the invention relate to an engagement apparatus for use in coupling a marine craft, such as a rigid inflatable boat (RIB), from/to a mother ship.

BACKGROUND OF THE INVENTION

Marine craft such as RIB's are often deployed and/or recovered from a mother vessel, such as a boat. For example, satellite boats such as lifeboats, rescue boats and landing craft are often launched from and recovered to larger mother ships, where the satellite boats are often stowed for journeys over long distances to a particular location. Satellite boats are often intended for a specific purpose, such as high speed operations, and may be less suitable for long journeys in exposed waters than the mother ship.

Satellite boats are often launched from the stern of a mother ship by lifting into the water such as with a crane; or by lowering via a ramp or a slipway. Alternatively, satellite boats are launched from the lee of a mother vessel: typically lowered over the side by a winch. Unless the mother vessel can accommodate the satellite boat within a wet dock accessible via a stern door, the satellite boat is generally recovered to the mother vessel by hauling the boat at least partially out of the water, such as with a crane.

The launch and/or recovery of the satellite boat may require the mother vessel to alter its course, typically slowing down and often coming to a standstill to control a relative position between the satellite boat and the mother vessel. However, altering the course of the mother ship may be detrimental to other operations, such as increasing journey time of the mother ship to a destination. Slowing the mother ship and/or the satellite boat may affect their movement in the water, such as the roll, pitch and yaw; which may hamper the recovery or launch. Furthermore, waiting to slow the mother vessel down may be detrimental to the operation of the satellite boat: for example, delaying the launch of a lifeboat to perform a rescue.

In order to recover the satellite boat, a line is typically thrown from either the mother vessel or the satellite boat, which is then captured by a crew member of the satellite boat and tied to permit the satellite boat to be hauled aboard the mother ship.

However, this conventional arrangement may not be possible or desirable in many situations. For example, in high sea states it may not be possible for a crew member to safely capture the line from the mother ship, thus making recovery of the satellite boat impossible or posing an unacceptable safety risk. Alternatively, the satellite boat may comprise an unmanned or remotely operated vehicle whereby there is no crew member available to capture the line.

SUMMARY OF THE INVENTION

According to a first aspect of the present invention, there is provided a marine craft engagement apparatus for use in the recovery of a marine craft to a mother ship, the apparatus comprising:

a receptacle adapted to be coupled to one of a mother ship and a marine craft;

an engagement probe adapted to be coupled to the other of the mother ship and the marine craft, wherein the engagement probe is adapted to engage one or more engagement locations in the receptacle to align the probe with the receptacle; and a locking device configured to secure the probe to the receptacle to secure the marine craft to the mother ship for recovery.

In use, embodiments of the present invention facilitate accurate and secure engagement between a marine craft to be recovered and the mother ship with little or no human intervention or skill. Accordingly, recovery of the marine craft may be achieved quickly and reliably in environments where there would otherwise be high risk of injury to crew or passengers on either vessel, such as high sea states or in subsurface environments; where either or both vessels are to be manoeuvred by relatively unskilled persons; or in cases where the craft to be recovered is remotely operated or unmanned.

The marine craft engagement apparatus may be configured for use in the deployment of the marine craft from the mother ship.

The receptacle may be coupled to, or provided on, the mother ship and the engagement probe may be coupled to, or provided on, the marine craft to be recovered. Alternatively, the receptacle may be coupled to, or provided on, the marine craft to be recovered and the engagement probe may be coupled to, or provided on, the mother ship, as required.

The receptacle may comprise a plurality of engagement locations for receiving the engagement probe. The engagement locations may be of any suitable form and may, for example, comprise a plurality of spaced holes, slots or channels located in a wall of the receptacle. In particular embodiments, the engagement locations comprise a plurality of vertically spaced channels.

The provision of a plurality of engagement locations facilitates engagement between the probe and the receptacle even where there is significant relative motion, between the receptacle and the probe, for example significant vertical motion as may be the case in high sea states. The provision of slots or channels facilitates location of the probe in the receptacle in conditions where there is significant relative sideways motion between the mother ship and the marine craft to be recovered.

The receptacle may be formed or otherwise configured to receive the probe. For example, the receptacle may comprise at least one ramp for directing the probe into the, or each, engagement location on initial engagement. The ramp may extend from the receptacle. Alternatively, or in addition, at least one engagement location may comprise a tapered entrance. Beneficially, the provision of a ramp or tapered entrance assists in directing the probe into an engagement location or plurality of engagement locations, thereby obviating or mitigating the possibility that the probe will become lodged between engagement locations or only partially engage a given engagement location or locations.

The receptacle may further comprise at least one recess configured to receive a leading end of the probe. For example, the receptacle may comprise one or more recess corresponding to each engagement location.

The engagement probe may be of any suitable form. For example, the probe may comprise a first portion arranged to initially engage the receptacle. In use, the probe first portion may be arranged to initially engage the receptacle to assist in accurately aligning the probe with the receptacle with little or no human intervention.

The probe first portion may comprise a dagger or other male projection.

The probe first portion may be formed or otherwise configured to mate with the engagement location. For example, the first portion may be shaped to conform to the engaged hole, slot, channel or other engagement location. In some embodiments, a leading end of the probe first portion may be shaped to conform to the recess provided in the receptacle. Alternatively, or in addition, a base of the probe first portion may be shaped to conform to the mouth of the engagement location. Further alternatively or additionally, an intermediate portion of the probe first portion may be shaped to conform to a wall of the engagement location.

The probe may comprise one first portion. Alternatively, the probe may comprise a plurality of first portions.

The probe first portion may also be configured to provide gripping engagement between the probe and the receptacle.

The probe may further comprise a second portion configured to engage an outer wall of the receptacle. The probe second portion may comprise any suitable arrangement. In particular embodiments, the probe second portion may comprise wings extending towards and configured to engage the outside of the receptacle. In use, the second probe portion, for example the wings, may engage the outside of the receptacle after initial engagement by the probe first portion to assist in alignment of the probe with the receptacle. The probe second portion may also be configured to provide gripping engagement between the probe and the receptacle.

The engagement probe may be provided in addition to, or may be integrated with, the marine craft's v-guide or other attachment device. The locking device may be provided on the probe and configured to engage the receptacle following alignment of the probe with the receptacle.

The locking device may be configured to engage an engagement location. For example, the locking device may be configured to engage the same engagement location as the probe first portion. The engagement locations may be formed to permit both the probe and the first and second probe portions to be received. In particular embodiments, however, the locking device may be configured to engage an adjacent or other different engagement location to that of the probe first portion.

Thus, engagement between the probe first portion with a given engagement location may ensure accurate alignment so that when the locking device is activated, secure engagement between the probe and receptacle may be ensured.

The locking device may be of any suitable form. For example, the locking device may comprise at least one of a latch, hook arm or other suitable securement device. In particular embodiments, two hook arms are provided, each arm configured to engage a corresponding shoulder in the receptacle. Each hook arm and shoulder may define right angle contact surfaces. Alternatively, each hook arm and shoulder may define corresponding acute angles, whereby the hook arm and shoulder provide a wedge lock.

It will be recognised that once the locking device engages the receptacle, such as where the hook arms engage the shoulders, forces acting to separate the probe and the receptacle will act to further secure the probe to the receptacle and prevent or at least mitigate unintended disengagement. These separating forces may be the result of, for example, astern (reverse) thrust by the marine craft or pull forces exerted on the receptacle by the mother ship.

Accordingly, in use the marine craft to be recovered may be directed into engagement with the receptacle; the probe first portion first engaging and aligning the marine craft with the receptacle and the locking device then being activated to secure the craft to the receptacle and thus the mother ship, facilitating transport of the marine craft towards the mother ship.

The engagement apparatus may further comprise an activation arrangement configured to activate the locking device. The activation arrangement may be of any suitable form. The activation arrangement may, for example, comprise at least one of: a mechanical activation arrangement; a hydraulic activation arrangement; a pneumatic activation arrangement; and an electric activation arrangement. In particular embodiments, the activation arrangement may comprise a spring coupled to the probe first portion. In use, on full engagement between the probe first portion and the engagement location, for example when the leading end of the probe first portion engages a recess, the probe first portion may be displaced axially against the spring, this axial movement activating, or generating a signal to cause activation of, the locking device.

The apparatus may further comprise an indicator arrangement configured to indicate the condition of the apparatus to a user, for example to the helmsman on the marine craft, to a crew member on the mother ship or to another remote location. In use, the indicator arrangement may, for example, be configured to indicate at least one of: alignment between the probe and the receptacle; engagement between the probe and the receptacle; full engagement between the probe first portion and an engagement location so that activation of the locking device may be initiated; and disengagement between the probe and the receptacle.

The indicator arrangement may comprise any suitable means. The indicator arrangement may be configured to indicate the condition of the apparatus by emission of a signal. In some embodiments, the indicator arrangement may comprise a device configured to emit a light signal, for example but not exclusively an LED, a lamp or other suitable device, or a radio frequency signal.

The indicator arrangement may comprise a visual indicator arrangement. Alternatively, or in addition, the indicator arrangement may comprise a tactile indicator arrangement. Alternatively, or in addition, the indicator arrangement may comprise an audible indicator arrangement.

The apparatus may further comprise a control system configured to initiate engagement and disengagement between the probe and the receptacle. In some embodiments, the control system may be configured to automatically initiate activation or deactivation of the locking device. In other embodiments, the control system may used in combination with the indicator arrangement and a user, whereby on receiving an appropriate signal from the indicator arrangement, the user is directed to operate the control system to activate or deactivate the locking device.

According to a further aspect of the present invention, there is provided a receptacle for an engagement apparatus according to the first aspect of the present invention.

According to a further aspect of the present invention, there is provided an engagement probe for an engagement apparatus according to the first aspect of the present invention.

According to a further aspect of the present invention, there is provided a method for engaging a marine craft to a mother ship for recovery and deployment, the method comprising:

providing a receptacle on one of a mother ship and a marine craft; and providing an engagement probe on the other of the mother ship and the marine craft;

engaging the engagement probe with one or more engagement locations in the receptacle to align the probe with the receptacle; and securing the probe to the receptacle to secure the marine craft to the mother ship.

Securing the probe to the receptacle may comprise activating a locking device provided on the probe. In particular embodiments, the locking device may be activated by full engagement between a probe first portion and the engagement location.

According to another aspect of the present invention there is provided a marine craft engagement apparatus comprising:

a first coupling adapted to be coupled to one of a mother ship and a marine craft to be recovered;

a second coupling configured to engage the first coupling, wherein the first and second couplings are arranged to latch on contact to secure the marine craft to the mother ship.

The coupling configured to engage the mother ship may be buoyant. The couplings may be of any suitable form and may, for example comprise at least one of a mechanical coupling, magnetic coupling, hydraulic coupling, and a pneumatic coupling.

The invention includes one or more corresponding aspects, embodiments or features in isolation or in various combinations whether or not specifically stated (including claimed) in that combination or in isolation. For example, it will readily be appreciated that features recited as optional with respect to one aspect may be additionally applicable with respect to another aspect, without the need to explicitly and unnecessarily list those various combinations and permutations here. Accordingly, it should be understood that any of the features defined above in accordance with any aspect of the present invention or described below in relation to an embodiment may be utilised, either alone or in combination with any other defined feature, in any other aspect of the invention.

BRIEF DESCRIPTION OF THE DRAWINGS

These and other aspects of the present invention will now be described, by way of example only, with reference to the accompanying drawings, in which:

FIG. 11 shows a side view of a probe according to another embodiment of the present invention;

FIG. 12 shows an enlarged view of part of the probe shown in FIG. 11.

FIG. 13 shows a top view of the probe shown in FIG. 11;

DETAILED DESCRIPTION OF THE DRAWINGS

Figure 1:
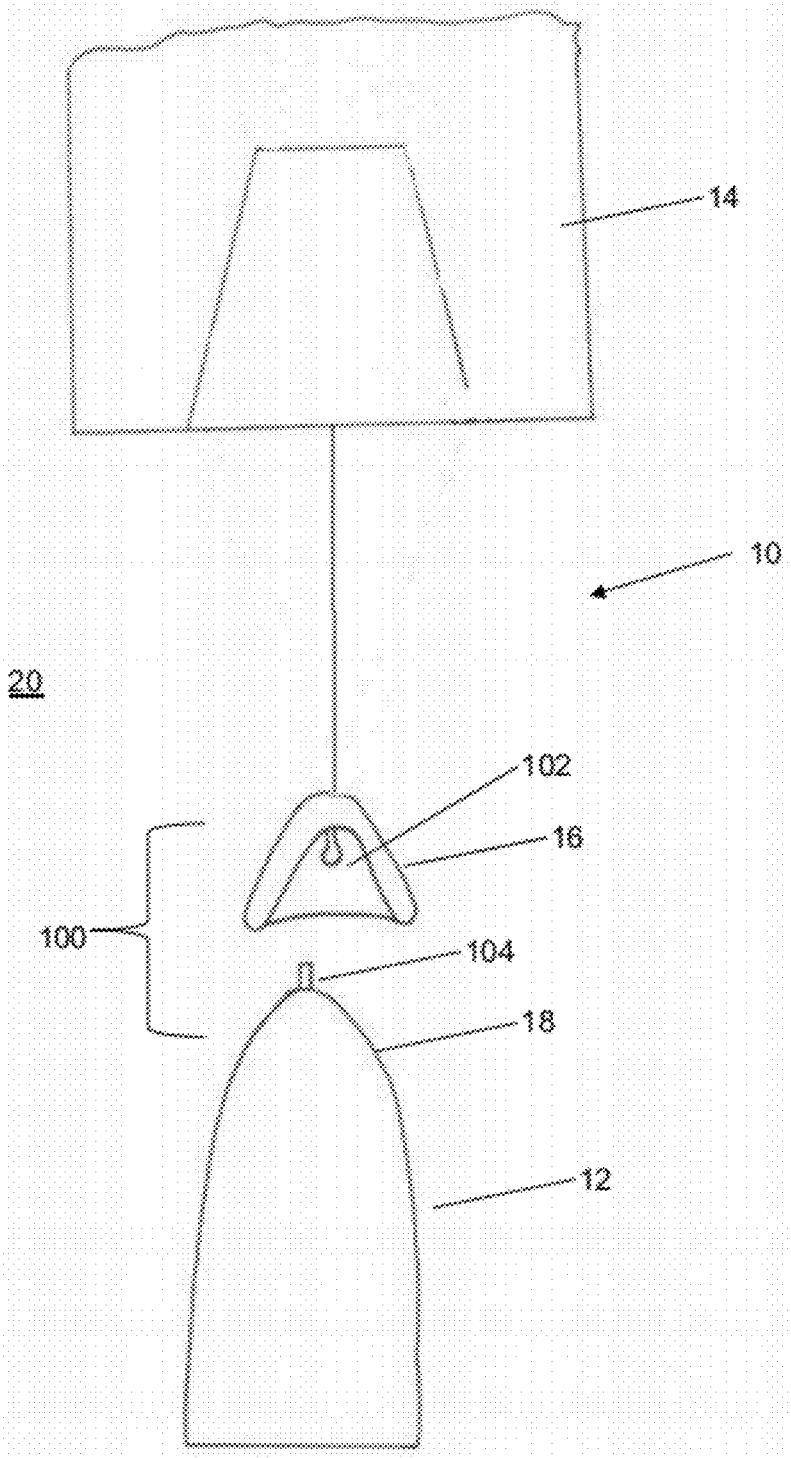
FIG. 1 shows a schematic plan view of the marine craft recovery system having an engagement apparatus according to an embodiment of the present invention.

Referring to FIG. 1 of the drawings, there is shown a system 10 for recovering a marine craft 12 to a mother ship 14. As shown, the system 10 has a hull engager 16 in the form of buoyant device coupled to the mother ship 14 and configured to receive at least part of the marine craft 12. In FIG. 1, the hull engager 16 is shown coupled to the mother ship 14 via a single line or cable. However, it will be recognised that the system 10 may alternatively employ any number of cables. In use, the marine craft 12 engages the hull engager 16 to permit the marine craft 12 to be recovered across a body of water 20 to the mother ship 14. Similarly, where it is desired to deploy the marine craft 12 from the mother ship 14, the marine craft 12 may be disengaged from the hull engager 16.

The hull engager 16 comprises an engagement apparatus 100 in order to provide safe and secure engagement between the marine craft 12 and the mother ship 14, the engagement apparatus 100 having a receptacle 102 and an engagement probe 104. In the embodiment shown in FIG. 1, the receptacle 102 is provided on the hull engager 16 and the probe 104 is provided on the marine craft 12 to be recovered, although it will be recognised that the receptacle 102 may alternatively be provided on the craft 12 and the probe 104 provided on the hull engager 16 as appropriate.

Figure 2:
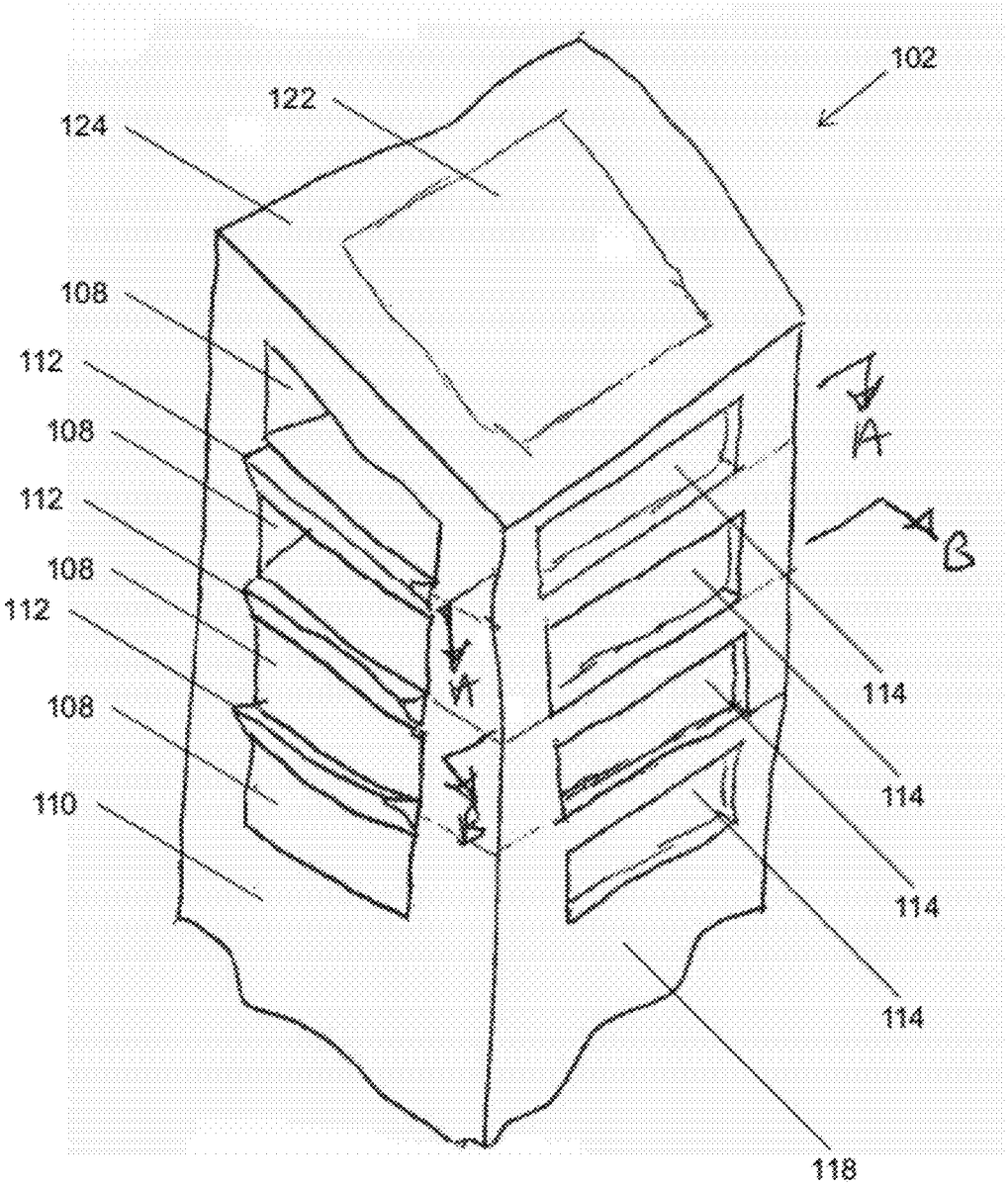
FIG. 2 shows a receptacle forming part of the engagement apparatus shown in FIG. 1.
Figure 3:
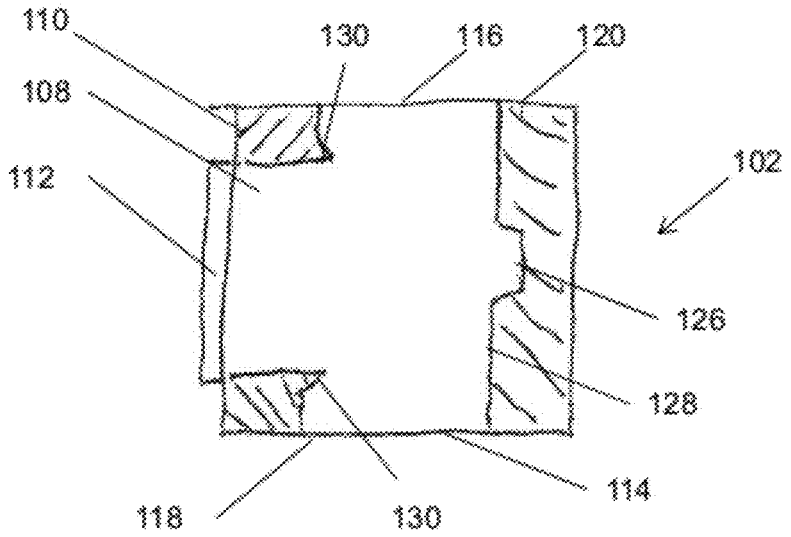
FIG. 3 shows a cross section view of the receptacle of FIG. 2, showing section A-A.
Figure 4:
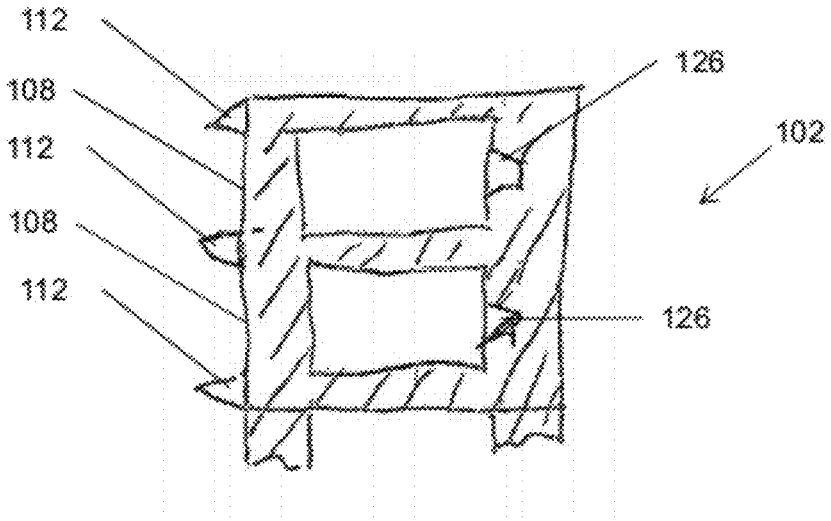
FIG. 4 shows a longitudinal section view of the receptacle of FIGS. 1 and 2, showing section B-B.

Referring to FIGS. 2 to 4 of the drawings, there is shown a receptacle 102 of the engagement system 100 according to an embodiment of the present invention. FIG. 2 shows a perspective view of the receptacle 102 and FIGS. 3 and 4 show cross section and longitudinal section views along A-A and B-B, respectively.

As shown in FIG. 2, the receptacle 102 comprises a generally square or rectangular section beam 106 having a number of vertically arranged openings in the form of holes or slots 108 (four slots 108 are shown in FIG. 2). The slots 108 are provided in a front surface 110 of the receptacle 102 and, in use, define engagement locations for receiving the probe 104. The slots 108 are machined, although any other suitable manufacturing technique may be used where appropriate. The provision of multiple slots 108 permits engagement between the probe 104 and the receptacle 102 to be achieved even when there is significant relative motion between the probe 104 and the receptacle 102. The slots 108 are of a size and shape to receive and permit activation of the probe 104 to secure the probe 104 to the receptacle 102, as will be described below.

Ramps 112 are provided between a number of the slots 108 and, in use, the ramps 112 provide a tapered entrance to the slots 108.

The receptacle 102 further comprises a number of slots 114,116 provided in side surfaces 118,120 of the receptacle 102. The slots 114,116 may provide space for a locking device, may allow water to escape and/or provide access for repair. A generally square hole 122 is also provided in a top surface 124 of the receptacle 102.

As shown in FIGS. 3 and 4, a number of notches or recesses 126 are also provided in an inside back surface 128 of the receptacle 102, and in the embodiment shown each slot 108 comprises a corresponding recess 126.

The receptacle 102 further comprises angled shoulders 130 and, in use, the probe 104 is adapted to engage the shoulders 130 to secure the probe 104 to the receptacle 102.

Figure 5:
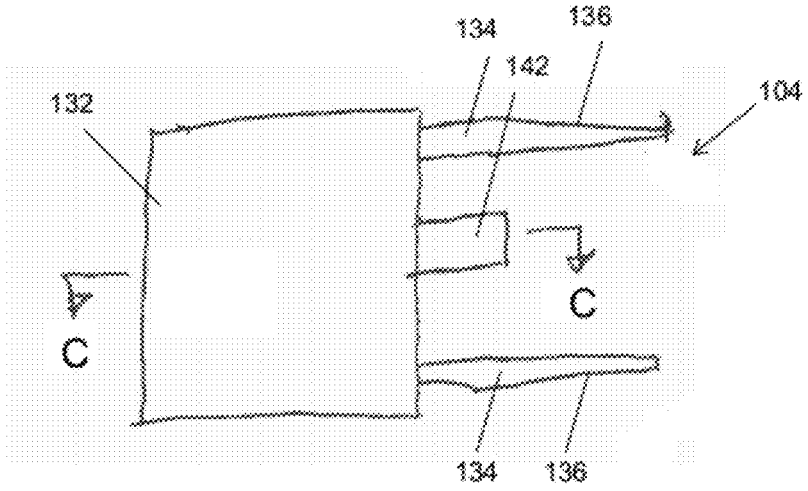
FIG. 5 shows a side view of a probe forming part of the engagement apparatus shown in FIGS. 1 to 4.
Figure 6:
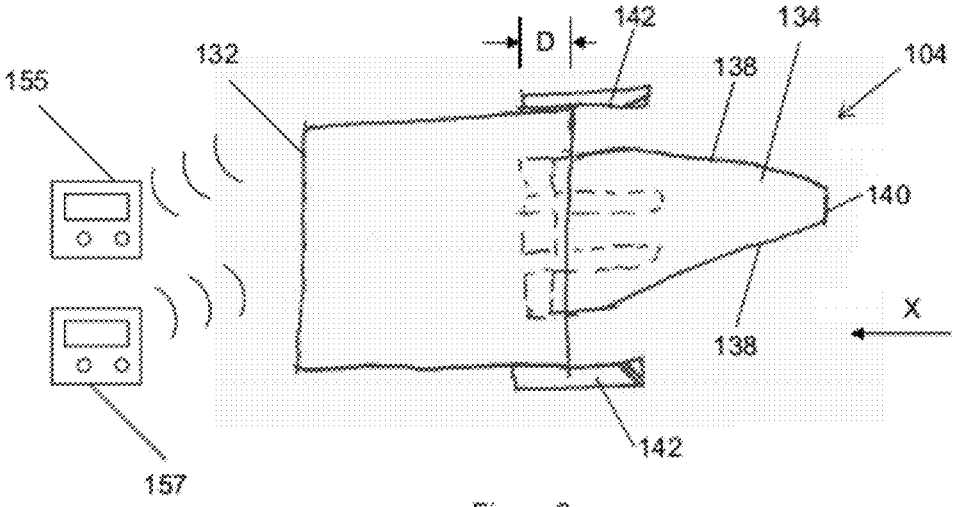
FIG. 6 shows a longitudinal section view of the probe of FIG. 5, showing section C-C.

A probe 104 according to an embodiment of the present invention is shown in FIGS. 5 and 6, the probe 104 for use with the receptacle 102 shown in FIGS. 2 to 4. FIG. 5 shows a side view of the probe 104 and FIG. 6 shows a longitudinal section view of the probe 104, showing section C-C of FIG. 5.

The probe 104 has a housing 132 and two probe first portions in the form of daggers 134. As shown in FIG. 5, the top surfaces 136 of the daggers 134 are tapered. As shown in FIG. 6, the side surfaces 138 of the daggers 136 are also tapered. In the embodiment shown, the daggers 134 are about 203.2 mm (8 inches) in length and about 152.4 mm (6 inches) at their widest point, although the daggers 134 may be of any suitable dimensions to permit engagement with the receptacle 102.

In use, when the marine craft 12 is directed towards the receptacle 102, the daggers 134, which form the leading end of the probe 104, engage with a given slot 108 and the distal-most end 140 of each dagger 134 engages with the respective recess 126 in the receptacle 102. When fully engaged with the recess 126, the daggers 134 conform to the recess so that there is no slop.

Figure 7:
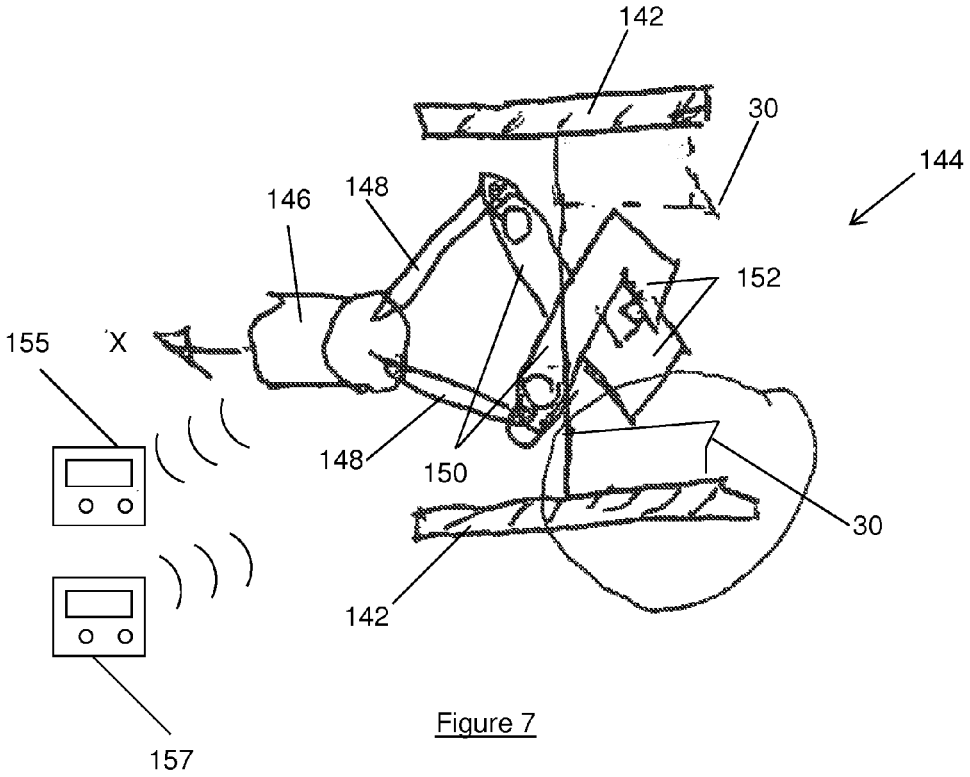
FIG. 7 shows a cross section view of part of the engagement apparatus shown in FIGS. 2 to 6, wherein the probe is engaged with the receptacle and showing a locking device prior to activation.

Wings 142 are also provided on the outer surfaces of housing 132 and, in use, the wings 142 engage the outer surfaces of the receptacle 104 (as shown most clearly in FIG. 7).

The daggers 134 are spring loaded so that at full engagement, that is when the distal most end 140 of the daggers 134 engage the recess 108, the dagger 134 will be depressed axially by a distance "D" in the direction shown by arrow "X" in FIG. 6, this movement triggering activation of a locking device 144, as will be described in more detail below. In the embodiment shown, the daggers 134 are configured to move a distance of about 12.7 mm (0.5 inch) to activate the locking device 144.

Figure 8:
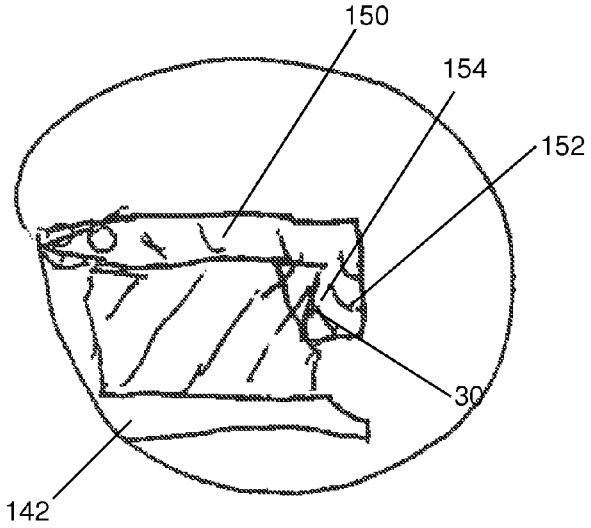
FIG. 8 shows an enlarged view of part of the locking device shown in FIG. 7, following activation/engagement with the receptacle.

Referring now to FIGS. 7 and 8 of the drawings, there is shown a locking device 144 according to an embodiment of the present invention for use in the engagement apparatus 100. The locking device 144 comprises an actuation arm 146 operatively coupled to the or each dagger 134. In use, axial depression of the dagger 134 in direction X following engagement with the recess 126 results in corresponding axial displacement of the arm 146. Articulated connection members 148, 150 are coupled to the arm 146, and in use axial displacement of the arm 146 causes the connection members 150 to pivot outwards in opposing directions to engage the receptacle 104, as shown in FIG. 8. The connection members 150 take the form of hook arms, the hook portion 152 arranged to engage the shoulders 130 in the receptacle 104. The hook portions 152 may further be provided with tapered surfaces 154 to further assist in securing the probe 104 to the receptacle 102.

In the embodiment shown, the locking device 144 is positioned so as to engage the slot 108 above the one engaged by the daggers 134, although it will be recognised that the locking device 144 may alternatively engage the same slot 108 as the daggers 134.

An indicator arrangement 155 is also provided to indicate the status of the apparatus to a user, for example to the helmsman or remote operator of the marine craft 12, to a crew member on the mother ship 14 or to another remote location. In the embodiment shown, the indicator arrangement 155 is configured to receive radio frequency signals from the apparatus 100 to indicate alignment between the probe 104 and the receptacle 102; full engagement between the dagger 134 and a recess 126 so that activation of the locking device may be initiated; and disengagement between the probe 104 and the receptacle 102.

The apparatus 100 further comprises a control system 157 configured to initiate engagement and disengagement between the probe 104 and the receptacle 102. In some embodiments, the control system 157 may be configured to automatically initiate activation or deactivation of the locking device 144. In other embodiments, the control system 157 may used in combination with the indicator arrangement 155 and a user, whereby on receiving an appropriate signal from the indicator arrangement 155, the user is directed to operate the control system 157 to activate or deactivate the locking device 144.

In use, the marine craft 12 is directed towards the hull engaging apparatus so that the probe 104 engages the receptacle 102. The daggers 134 of the probe 104 engage with a slot 108 of the receptacle 102 to align the probe 104 with the receptacle 102. At this stage, a first LED of the indicator arrangement 155 may be illuminated to indicate to the helmsman of the marine craft 12 or remote operator that the probe 104 and receptacle are aligned. On achieving full engagement between the daggers 134 and the recess 126, a second LED of the indicator arrangement may be illuminated to indicate to the helmsman or remote operator that the locking device 144 should be engaged, or in embodiments where the locking device 144 is automatically engaged, that the locking device 144 is engaged.

When recovering the marine craft, the second LED will signal to the helmsman or remote operator to initiate reverse thrust, this securing or further securing the probe 104 to the receptacle 102 to facilitate transport of the marine craft 12 to the mother ship 14. During deployment, the helmsman or remote operator will also maintain reverse thrust and the engaged light will be lit. To disengage, the helmsman or remote operator pushes a disengage switch or button, and should switch to forward thrust.

Figure 9:
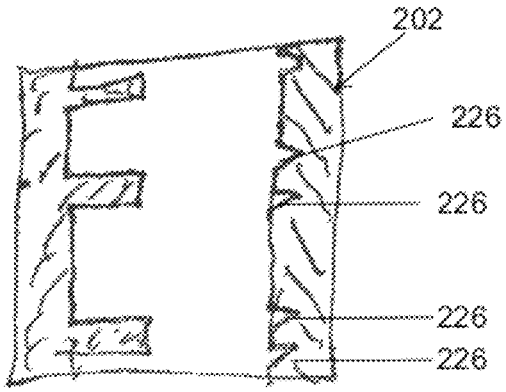
FIG. 9 shows a longitudinal section view of a receptacle according to an alternative embodiment of the present invention.
Figure 10:
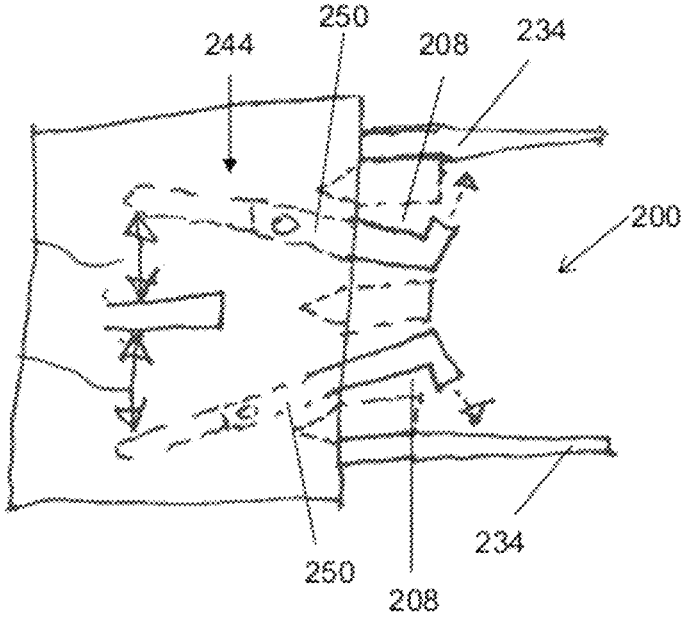
FIG. 10 shows a longitudinal section view of part of the engagement apparatus of the embodiment shown in FIG. 9 and showing an alternative locking device prior to activation.

Referring now to FIGS. 9 and 10 of the drawings, there is shown an apparatus 200 according to an alternative embodiment of the present invention. The apparatus 200 is similar to the apparatus 100 shown in FIGS. 1 to 8 and corresponding features are represented by corresponding numerals incremented by 100.

FIG. 9 shows a longitudinal section view of a receptacle 202 according to the alternative embodiment of the present invention. The receptacle 202 is outwardly identical to the receptacle 102 shown in FIG. 2. The receptacle 202 differs in its internal geometry from the receptacle 102 by having two recesses 226 provided in each slot 208, the recesses 226 provided at axially spaced locations so as to receive daggers 234 of probe 204.

FIG. 10 shows a longitudinal section view of part of the apparatus 200, wherein the probe 204 is positioned within the receptacle 202 and prior to engagement of locking device 244. In this alternative embodiment, hook arms 250 are configured to pivot vertically to engage shoulders 230 in the receptacle 202 and secure the probe 204 to the receptacle 202.

The apparatus 200 also comprise an indicator arrangement 255, the indicator arrangement corresponding to the arrangement 155 described in relation to the first embodiment of the invention.

Referring now to FIGS. 11 to 15, there is shown an apparatus 300 according to a further alternative embodiment of the invention. Like components between the apparatus 100 or 200 and apparatus 300 are shown by like numerals.

FIG. 11 shows a side view of a probe 304 according to this embodiment. FIG. 12 shows an enlarged view of part of the probe 304 shown in FIG. 11. FIG. 13 shows a top view of the probe 304. As shown, a rear portion of the probe 304 comprises a mounting block or housing 332 having a recess 342 shaped to conform to a hull, in particular a bow, of a marine craft. A front portion of the wall of the recess 342 is sloped (shown in hidden line in FIG. 11). An anchor attachment point extends from the mounting block and permits the probe 304 to be secured to the marine craft. Almost all marine crafts have an anchor attachment eye on their bow, the attachment eye being capable of withstanding considerable loading. Beneficially, the attachment eye can be removed and replaced by the probe 304 with little alteration to the bow.

A front portion of the probe 304 comprises a dagger 334 having a distal leading end 340, a tapered upper surface 336 and tapered side surfaces 338. The lower surface 359 may also be tapered. A latching recess 361 is provided on the dagger 334 between the tapered upper surface 336 and the housing 332, the latching recess 361 defining a latching surface 363.

Figure 14:
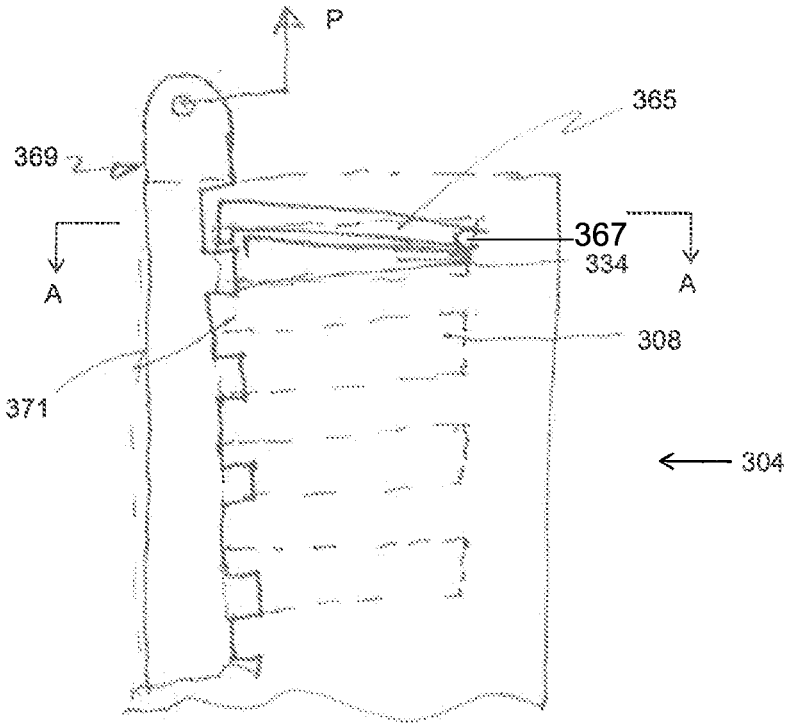
FIG. 14 shows a longitudinal section view of a receptacle for receiving the probe of FIGS. 11 to 13.
Figure 15:
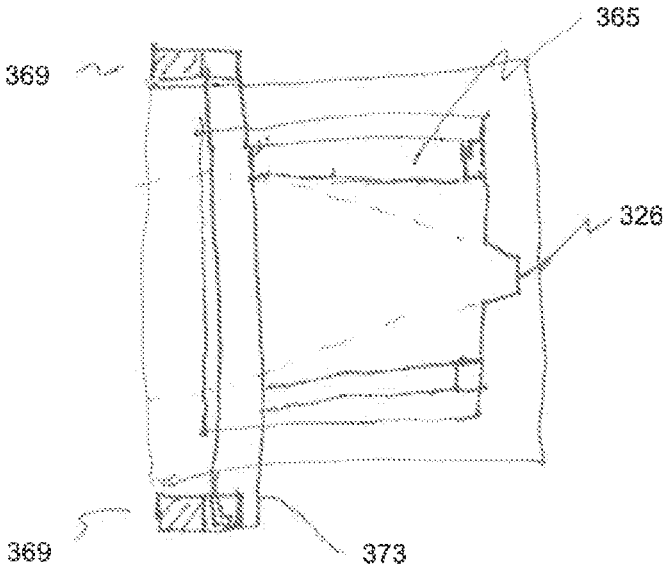
FIG. 15 shows a cross sectional view of section A-A of FIG. 14.

Reference is now made also to FIGS. 14 and 15 which show an alternative receptacle 302. FIG. 14 shows a longitudinal section through the receptacle 302. FIG. 15 shows a cross sectional view of section A-A of FIG. 14. As shown, the receptacle 302 comprises latching brackets 365 in each slot 308, the latching brackets 365 being mounted to the receptacle 302 via hinges 367.

Two latching bars 369 are mounted to each side of the receptacle 302 in a manner which permits the latching bars 369 to be capable of sliding up and down. The latching bars 369 are mechanically connected at the top to permit an actuator, such as the actuator described above, to pull up the latching bars 369 (in the direction P) to an unlatched position whereby the bracket is located in a slot 371. In use, movement of the latching bars 369 to the unlatched position will pivot the latching brackets 365 to the unlatched position.

As shown in FIG. 15, the latching brackets 365 comprise extensions 373 which engage with the latching bars 369. Also, recesses 326 are provided in the wall of the receptacle 302 and are each fitted with electrical switches to indicate the engagement state of the apparatus 300.

When the hull engager is deployed for engagement, the latching bars 367 are lifted partially up, but are still below a disengaged position. This will allow increased clearance between the latching bracket 365 and the dagger 334 as it enters. As the dagger 334 approaches full engagement, contact between the dagger 334 and the latching bracket 365 will be made and the latching bracket 365 will be rotated upwards. When full engagement is made, the latching bracket 365 will fall partially into the latching recess 361 (FIGS. 11 and 12). Upon the controller receiving a fully engaged signal, the latching bars 367 will lower, thus allowing full mating of the latching bracket 365 with the dagger 334.

It should be understood that the embodiment described herein is merely exemplary and that various modifications may be made thereto without departing from the scope of the invention.

For example, in the embodiments shown, the marine craft is a RIB. However, the skilled person will appreciate the system may be for other marine crafts, such as a submersible craft; and/or a semi-submersible craft.

Similarly, where the marine craft shown here is manned, the skilled person will appreciate that the marine craft may be unmanned, such as an autonomous or remotely-controlled craft. It will be understood that references to a helmsman or user on the marine craft should, when the marine craft to be recovered is unmanned, be taken to mean a remote operator.

Although shown in the embodiments here as a powered boat, the boat may comprise an unpowered boat, such as a sailboat. Similarly, where the mother ship shown here is a larger boat, the mother ship may be another marine structure, such as a submarine or a platform, such as a floating platform, or other location to which the marine craft is to be secured, recovered and/or deployed.

In some embodiments, the hull engager on which at least part of the engagement apparatus may be mounted or coupled may comprise a hull dock configured to receive at least a portion of a hull of the marine craft, such as a bow section. The dock may comprise a rigid body, for example manufactured from CRES or other suitable material, with hard rubber backed internal sides to receive the marine craft to be recovered. The dock has a bottom portion with an inclined internal face sloping rearwards, such that the bow portion is raised as it is manoeuvred into the bow dock.

In use, the hull dock may be deployed and retrieved from the mother ship and the engagement apparatus operated to engage and secure the marine craft to the hull dock and thus the mother ship for recovery or deployment. In further alternative embodiments, the hull engager may be directly coupled to the mother ship hull.

The engagement apparatus may resist or prevent disengagement between the marine craft to be recovered and the hull engager during launch and/or recovery, for example by providing the angled shoulders to which the probe is adapted to be engaged to secure the probe to the receptacle. In use, it is envisaged that the connection between the hull engager or probe and the receptacle should be slack. This may be achieved by the helmsman or remote operator of the marine craft positioning the craft relative to the mother ship so as to have slack cables, for example before and/or after the actuator is activated.

The apparatus and methods of the present invention may also be used in combination with the marine craft recovery system and associated method described in applicant's U.S. Ser. No. 13/041,938, which is incorporated herein in its entirety by way of reference.

The invention claimed is:

1. An engagement apparatus for use in the recovery of a marine craft to a mother ship, the apparatus comprising:

a receptacle adapted to be coupled to one of a mother ship and a marine craft;

an engagement probe adapted to be coupled to the other of the mother ship and the marine craft, wherein the engagement probe is adapted to engage one or more engagement locations in the receptacle to align the probe with the receptacle; and a locking device configured to secure the probe to the receptacle to secure the marine craft to the mother ship for recovery, wherein the engagement probe comprises a latching recess and the receptacle comprises latching brackets for engaging the latching recess, and wherein at least one of:

the receptacle is coupled to the marine craft to be recovered and the engagement probe is coupled to the mother ship;

the receptacle comprises a plurality of engagement locations, the engagement locations comprising a plurality of spaced channels located in a wall of the receptacle;

the receptacle comprises at least one ramp for directing the engagement probe into an engagement location;

wherein the receptacle further comprises at least one recess configured to receive a leading end of the engagement probe, the receptacle comprising at least one recess corresponding to each engagement location; and the locking device comprises at least one hook arm configured to engage a corresponding shoulder in the receptacle.

2. The apparatus of claim 1, wherein the receptacle is coupled to the mother ship and the engagement probe is coupled to the marine craft to be recovered.

3. The apparatus of claim 1, wherein at least one of the receptacle and the engagement probe is provided on a hull engaging apparatus configured to receive at least a portion of a hull of the marine craft.

4. The apparatus of claim 1, wherein the receptacle is configured to receive the engagement probe.

5. The apparatus of claim 1, wherein at least one engagement location comprises a tapered entrance.

6. The apparatus of claim 1, wherein the engagement probe comprises at least one probe first portion arranged to initially engage the receptacle.

7. The apparatus of claim 6, wherein the engagement probe first portion comprises at least one dagger.

8. The apparatus of claim 1, wherein the engagement probe further comprises a second portion configured to engage an outer wall of the receptacle.

9. The apparatus of claim 1, wherein the locking device is provided on the engagement probe and is configured to engage the receptacle following alignment of the engagement probe with the receptacle.

10. The apparatus of claim 1, further comprising an activation arrangement configured to activate the locking device.

11. The apparatus of claim 1, further comprising an indicator arrangement configured to indicate the condition of the apparatus.

12. The apparatus of claim 1, further comprising a control system configured to initiate engagement and disengagement between the probe and the receptacle.

13. The apparatus of claim 1, wherein the latching brackets are mounted to the receptacle via hinges.

14. A method for engaging a marine craft to a mother ship for recovery, the method comprising:

providing a receptacle on one of a mother ship and a marine craft; and providing an engagement probe on the other of the mother ship and the marine craft, wherein the engagement probe comprises a latching recess and the receptacle comprises latching brackets for engaging the latching recess;

engaging the engagement probe with one or more engagement locations in the receptacle to align the probe with the receptacle; and securing the probe to the receptacle to secure the marine craft to the mother ship, and wherein at least one of:

the receptacle is coupled to the marine craft to be recovered and the engagement probe is coupled to the mother ship;

the receptacle comprises a plurality of engagement locations, the engagement locations comprising a plurality of spaced channels located in a wall of the receptacle;

the receptacle comprises at least one ramp for directing the engagement probe into an engagement location;

wherein the receptacle further comprises at least one recess configured to receive a leading end of the engagement probe, the receptacle comprising at least one recess corresponding to each engagement location; and the locking device comprises at least one hook arm configured to engage a corresponding shoulder in the receptacle.

* * * * *